US009719287B1

(12) United States Patent
Chapman et al.

(10) Patent No.: US 9,719,287 B1
(45) Date of Patent: Aug. 1, 2017

(54) ASTRAGAL WITH COVERED SLIDABLE LOCK BLOCK

(71) Applicant: Global Products International Group, LLC, Atlanta, GA (US)

(72) Inventors: Gabriel Paul Chapman, Cumming, GA (US); Ryan H. Chapman, Atlanta, GA (US); Nathan D. Meraz, Atlanta, GA (US)

(73) Assignee: GLOBAL PRODUCTS INTERNATIONAL GROUP, LLC, Atlanta, GA (US)

( * ) Notice: Subject to any disclaimer, the term of this patent is extended or adjusted under 35 U.S.C. 154(b) by 0 days.

(21) Appl. No.: 15/013,599

(22) Filed: Feb. 2, 2016

(51) Int. Cl.
*E05C 7/04* (2006.01)
*E06B 3/36* (2006.01)
*E05B 17/20* (2006.01)

(52) U.S. Cl.
CPC ..... *E06B 3/365* (2013.01); *E05B 17/2034* (2013.01); *E05C 7/045* (2013.01)

(58) Field of Classification Search
CPC . E05C 7/045; E05C 7/04; E05C 1/065; E05C 1/04; Y10T 292/102; Y10T 292/0834; Y10T 292/21; Y10T 292/15; Y10T 292/31; E06B 3/365
See application file for complete search history.

(56) References Cited

U.S. PATENT DOCUMENTS 1,225,285 A * 5/1917 Swaim ..... E05C 17/446 290/30 A
2,815,975 A * 12/1957 Check ..... E05C 1/065 292/143
2,819,107 A * 1/1958 Muessel ..... E05C 1/065 292/143
3,556,573 A * 1/1971 Miller ..... E05C 1/065 292/143
3,649,060 A * 3/1972 Ruff ..... E05C 1/04 292/147
4,315,647 A * 2/1982 Wilzig ..... E05C 1/065 292/143
5,350,207 A 9/1994 Sanders
6,491,326 B1 * 12/2002 Massey ..... E05C 1/04 292/162
6,905,152 B1 * 6/2005 Hudson ..... E05C 1/065 292/143
7,036,854 B1 * 5/2006 Lai ..... E05C 1/065 292/141
7,494,163 B2 2/2009 Monts de Oca
7,543,860 B2 * 6/2009 Meeks ..... E05C 1/04 292/137
7,735,882 B2 * 6/2010 Abdollahzadeh ..... E05C 7/04 292/44

(Continued)

*Primary Examiner* — Justin Rephann
(74) *Attorney, Agent, or Firm* — Thomas | Horstemeyer, LLP

(57) ABSTRACT

An astragal assembly for use with double doors containing a slidable lock block with a moveable cover. The movable slidable lock block cover may be moved between an open position, wherein the slidable lock block can be moved between locked and unlocked positions, and a closed position, wherein the slidable lock block is immobilized. Accordingly, the slidable lock block cover increases the security of the double doors by preventing actuation of the slidable lock block when the double doors are closed.

18 Claims, 7 Drawing Sheets

(56) References Cited

U.S. PATENT DOCUMENTS

| | | | | |
|---|---|---|---|---|
| 8,157,299 | B2 * | 4/2012 | Mitchell | E05C 7/04 292/197 |
| 8,556,306 | B1 * | 10/2013 | Lin | E05C 7/045 292/157 |
| 9,051,763 | B2 * | 6/2015 | Taylor | E05C 9/185 |
| 9,145,718 | B1 * | 9/2015 | Lin | E05C 1/004 |
| 2005/0116424 | A1 | 6/2005 | Sanders | |
| 2007/0205609 | A1 * | 9/2007 | Meeks | E05C 1/04 292/137 |
| 2008/0157544 | A1 * | 7/2008 | Phipps | E05B 17/2053 292/138 |
| 2010/0107503 | A1 | 5/2010 | Chapman | |
| 2012/0001443 | A1 * | 1/2012 | Mitchell | E05B 63/242 292/341.16 |
| 2012/0074714 | A1 * | 3/2012 | Saccon | E05B 5/00 292/157 |

* cited by examiner

ASTRAGAL WITH COVERED SLIDABLE LOCK BLOCK

TECHNICAL FIELD

The present disclosure generally relates to an astragal for closing a space between two double doors, and more particularly relates to an astragal having a slidable lock block for securing the inactive door to the door sill or frame.

BACKGROUND

The present disclosure generally relates to an astragal for closing a space between two double doors, and more particularly relates to an astragal having a slidable lock block for securing the inactive door to the door sill or frame. Double doors are common in homes and buildings. Typically, a set of double doors includes an inactive door and an active door, which are positioned adjacent to each other with a common door frame. While both doors are capable of opening, the active door is generally used for routine ingress and egress, while the inactive door is generally kept closed and is only opened in special cases, such as when a wider opening is desired. Double doors are particularly common on the exterior walls of homes and buildings, where they may be mounted either as outswing doors, which open toward the exterior of the home or building, or inswing doors, which open toward the interior of the home or building.

In such double doors, the inactive door is usually associated with an astragal, which is a jamb-like structure extending along a vertical inside edge of the inactive door, opposite from a hinged edge. Embodiments of astragals are disclosed in U.S. Pat. No. 5,350,207 to Sanders, U.S. Pat. Pub. No. 2005/0116424 by Sanders, and U.S. pat. Pub. No. 2010/0107503 to Chapman, each of which is incorporated by reference. The astragal may facilitate locking the inactive door in a closed position. For example, the astragal may house upper and/or lower locking bolts that are operatively connected to a slidable lock block, lever, or other actuator. When the slideable lock block is moved into a locked position, the bolts may extend into corresponding wells in the door frame to lock the inactive door against the door frame. When the slidable lock block is moved into an unlocked position, the bolts may retract from the wells to unlock the inactive door.

The astragal may also facilitate locking the active door against the inactive door. For example, the astragal may have a flange that forms a door stop for capturing the active door as it closes. The astragal may also have an opening surrounded by a strike plate, and the active door may have a door knob with a bolt. When the active door is closed, the bolt of the active door may enter the opening in the astragal to hold the active door closed against the astragal.

The astragal may also form a seal between the two doors when the active door is closed, to reduce the passage of air, light, water, debris, and pests into the home or building. For example, the astragal may provide a mounting surface for a sealing member such as weather stripping.

One common problem is that, even if the astragal provides a sealing member such as weather stripping, there is still a potential security problem presented by double doors, particularly outswing double doors on the exterior wall of a home or building. Specifically, on outswing double doors, a small gap may be accessible between the astragal and the active door from the exterior of the home or building. On traditional astragal assemblies, such a gap could provide access from the exterior of the home to actuate a slidable lock block, moving it from a locked to an unlocked position, and thereby gaining illicit access to the home or building.

One solution to this problem is to use an astragal which houses a lever which can be used to actuate the locking bolt or bolts. Such a system is described in U.S. Pat. No. 7,494,163 to Montes de Oca. The length of such a lever requires several inches of space between the vertical inside edge of the active door and the astragal to rotate the lever and actuate the locking bolt or bolts between the locked and unlocked positions, and thus prevents actuation of the locking bolt or bolts from the exterior of a home or building when the double doors are closed. One issue with the lever-actuated locking bolt is that these bolts can only be extended a limited distance into the door frame, typically only about three-quarters of an inch, as compared to locking bolts which are actuated by slidable locks, which can extend up to about one and one half inches into the door frame. Because the lever-actuated locking bolts do not extend as far as locking bolts actuated by slidable locks, astragals with lever-actuated locking bolts can withstand less force than astragals with slidable locks. Another issue with the lever-actuated locking bolt is that it is significantly (potentially more than 50%) more expensive than a slidable lock.

Another solution to this problem is to use a slidable lock, but to add an additional security cover to cover the gap between the astragal and the active door on the exterior of the home or building. One issue with the separate security cover is the significant added cost, which is often even more expensive than a lever-actuated locking bolt. Another issue with the separate security cover is that it prevents additional aesthetic challenges. For example, such security covers must be manufactured to match the textures and color of the double doors, be paintable, and have a generally pleasing shape.

From the above, it is apparent that a need exists for an astragal assembly which utilizes a slidable lock mechanism, yet which prevents actuation of the slidable lock mechanism when the double doors are closed. This need is particularly apparent on outswing double doors, where the astragal assembly may use a slidable lock mechanism, yet prevent actuation of the slidable lock mechanism from the exterior of a home or building.

SUMMARY

Thus, there is provided an astragal assembly for use with a double door installation that includes an active door and an inactive door having substantially abutting generally vertical inside edge portions when the doors are closed, said astragal assembly comprising:

- an elongated astragal strip extending along the vertical inside edge portion of the inactive door when the inactive door is closed and being securable to the vertical inside edge portion of the inactive door;
- a door stop on said astragal strip for engaging the active door when closed;
- a slidable lock block mounted in said astragal strip, said lock block comprising a projecting bolt selectively positionable between a locked position for immobilizing the astragal strip and inactive door and, alternatively, an unlocked position for releasing the astragal strip and inactive door; and
- a lock block cover on said astragal strip proximate the slide lock block and comprising a cover portion which is selectively moveable between a closed position, wherein the cover portion is substantially flush with the astragal strip and the cover portion blocks access to the slide lock block and inhibits actuation of the projecting bolt between the locked and unlocked positions, and, alternatively, an open position, wherein the slidable lock block is accessible for movement of the projecting bolt between the locked and unlocked positions.

Described below is an improved astragal assembly which uses a slidable lock block, yet prevents actuation of the locking bolts when the double doors are closed. The astragal assembly is intended for use with a double door installation that includes an active door and an inactive door having substantially abutting generally vertical inside edge portions when the doors are closed, and comprises: an astragal strip extending along the vertical inside edge portion of the inactive door, a door stop on said astragal strip for engaging the active door when closed, a slidable lock block mounted in the astragal strip which comprises a projecting locking bolt capable of immobilizing the astragal strip and the inactive door, and a slidable lock block with a lock block cover which inhibits actuation of the slidable lock. The slidable lock block cover is selectively movable between an open position, wherein the slidable lock and projecting locking bolt may be moved between a locked and an unlocked position, and alternatively, a closed position, wherein the slidable lock block and projecting locking bolt immobilized such that they cannot be moved between the unlocked and locked positions.

Other systems, devices, methods, features, and advantages of the disclosed astragal with covered sliding lock will become apparent to one with skill in the art upon examination of the following figures and detailed description. All such additional systems, devices, methods, features, and advantages are intended to be included within the description and are intended to be protected by the accompanying claims.

BRIEF DESCRIPTION OF THE FIGURES

The present disclosure may be better understood with reference to the following figures. Matching reference numerals designate corresponding parts throughout the figures, and components in the figures are not necessarily to scale.

DETAILED DESCRIPTION

Figure 1:
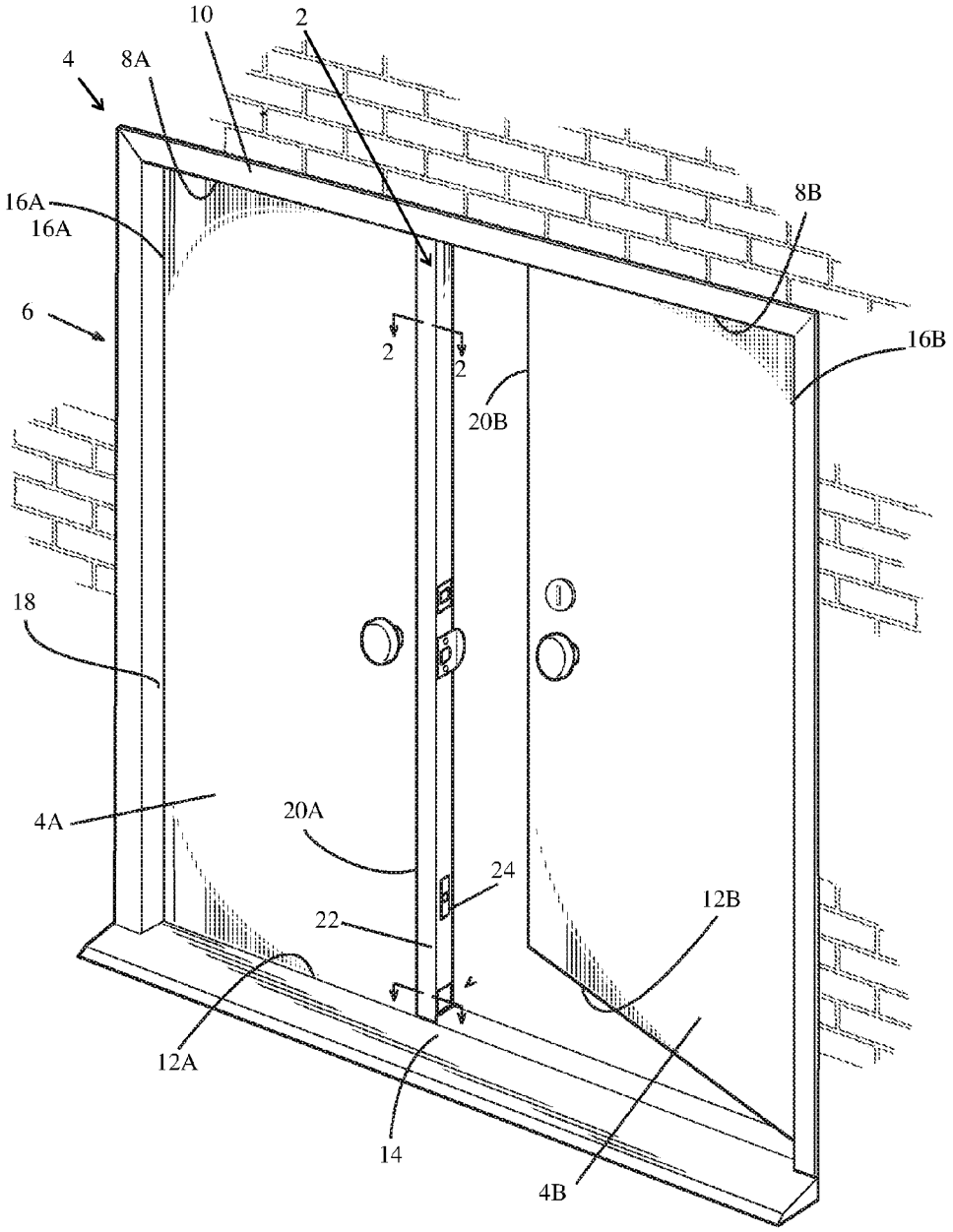
FIG. 1 is a perspective view of an astragal assembly, illustrating the astragal assembly positioned between double doors.

Described below are embodiments of an astragal assembly with a covered slidable lock block and like reference numerals refer to like parts throughout the drawing figures. The astragal assembly may be associated with an inactive door of a double door set. The covered slidable lock block may be positioned on a lower or upper end of the astragal assembly adjacent to a sill and/or the door frame. The slidable lock block may be actuated between an unlocked position, wherein a locking bolt is contained within the astragal assembly, and a locked position, wherein a locking bolt extends into the door frame and/or door sill. The slidable lock block has a cover which may be moved between an open position, wherein the slidable lock block can be actuated between the locked and unlocked positions, and a closed position, wherein the slidable lock is immobilized and cannot be actuated between the locked and unlocked positions.

In certain embodiments, the slidable lock block cover has a hinge such that the lock block cover can be rotated on the hinge between the open and closed positions. In certain embodiments, the hinged slide lock block cover opens towards the active door, such that closing the active door can move the hinged slidable lock block cover into the closed position.

FIG. 1 is a perspective view of an embodiment of an astragal assembly 2, illustrating the astragal assembly 2 positioned between a set of double doors 4A and 4B. As shown, the double doors 4 generally include an inactive door 4A and an active door 4B. The doors 4 are positioned adjacent to each other within a common door frame 6. More specifically, the inactive and active doors 4A and 4B may include respective upper edges 8A and 8B that abut the door frame 6 about an upper jamb head 10, respective lower edges 12A and 12B positioned adjacent to the door frame 6 near a lower sill 14, respective outside or hinged vertical edges 16A and 16B that are mounted to the door frame 6 along a vertical jamb 18, and respective inside or free vertical edges 20A and 20B located opposite from the outside or hinged edges 16A and 16B. Thus, the inside vertical edge portions 20A and 20B of the active door 4B and inactive door 4A overlie the sill 14 when the doors 4A and 4B are closed.

The astragal assembly 2 extends along the inside free edge 20A of the inactive door 4A. The astragal assembly 2 may include an elongated astragal jamb 22, which may be, for example, an extruded rigid member formed from aluminum, vinyl, fiberglass, plastic or wood, among others or combinations thereof. The astragal jamb 22 may be coupled to the inside free edge 20A of the inactive door 4A and may move with inactive door 4A. The inactive door 4A may be immobilized against the door frame 6 through the use of a slide lock mechanism 24. In the illustrated embodiment, the slide lock mechanism 24 is positioned on a lower end of the astragal assembly 2, although it will be understood that in other embodiments, slide lock mechanisms 24 could be placed on the upper end of astragal assembly 2, or on both the upper and lower ends of the astragal assembly 2.

Figure 2:
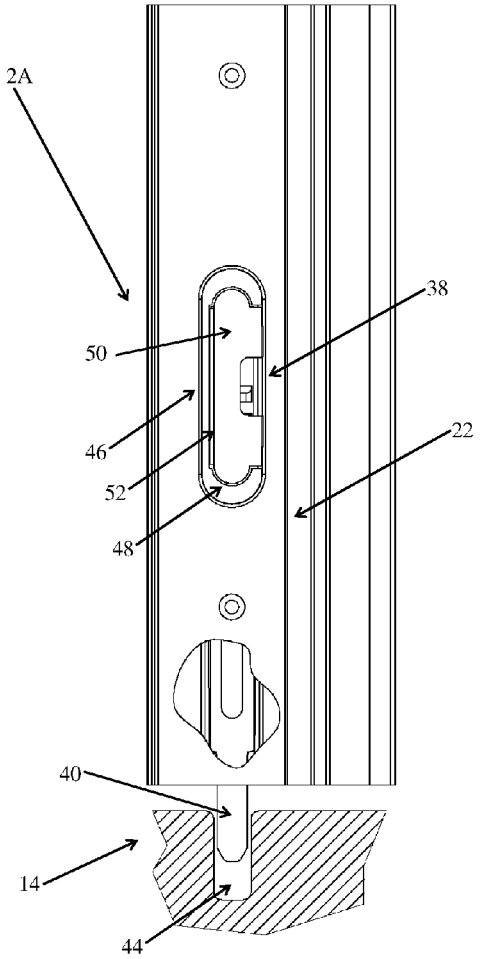
FIG. 2 is a partial side elevation view of the embodiment of the astragal assembly shown in FIG. 1, with a portion removed and illustrating the locking mechanism of the astragal assembly wherein the slidable lock block cover is closed.

With reference to FIG. 2, the astragal assembly 2A may include a slidable lock block 38 mounted in the rearward or inner astragal strip 28 and suited for locking the inactive door 4A in a closed position. For example, the slidable lock block 38, which is covered by the slidable lock block cover 46, may include an actuating member, such as a projecting locking bolt 40, that is operatively connected to an actuator 42. The projecting locking bolt 40 and the actuator 42 are both housed and mounted in the rearward or inner astragal strip 28. The actuator 42 may be engaged to selectively move the projecting locking bolt 40 between an extended, locked position for immobilizing the astragal strip 28 and inactive door 4A and, alternatively, a retracted, unlocked position for releasing the astragal strip 28 and inactive door 4A. In the extended position, the projecting locking bolt 40 may extend into a receiving well 44 of the lower sill 14 to hold the inactive door 4A closed. In the unlocked position, the locking bolt 40 may be retracted into the astragal assembly 2A so that the inactive door 4A may be opened. In the illustrated embodiment, not all details of the projecting locking bolt 40 are shown. However, it would be understood to one of ordinary skill in the art that several different locking bolt mechanisms could be used, such as those which are spring-loaded.

In this embodiment, the slidable lock block cover 46 comprises two portions; a frame portion 48, which may be connected to the astragal assembly 2A, and a cover portion 50, which is connected to the frame portion 48 through a hinge 52. The frame portion 48 may at least partially or completely surround the cover portion 50. Furthermore, according to some embodiments, the cover portion 50 of the lock block cover 46 may be substantially planar and rectangular or oval in shape, and comprise an outer surface which faces the vertical inside edge portion 20A of the closed active door 4A, and an inner surface which faces the slidable lock block 38. The cover portion 50 may selectively rotate on the hinge 52 between a closed position, wherein the cover portion 50 is substantially flush with the astragal strip 28 and the cover portion 50 blocks access to the slide lock block 38 and inhibits actuation of the projecting locking bolt 40 with the actuator 42 between the locked and unlocked positions, and, alternatively, an open position, wherein the slidable lock block 38 is accessible for movement of the projecting locking bolt 40 with the actuator 42 between the locked and unlocked positions. While this embodiment depicts a pin and barrel hinge 52, it should be understood that various means could be used to effect a moveable cover portion 50, such as a living hinge or a sliding mechanism.

The cover portion 50 may also comprise a finger pull mechanism 54 to enable a user to move the cover portion 50 between the open and closed positions. The cover portion 50 may also comprise at least one actuator stop 56 on its face which protrudes from the cover portion 50 and is configured such that, when the cover portion 50 is closed the actuator stop 56 protrudes toward the actuator 42, and inhibits actuation of the projecting locking bolt 40 by the actuator between the locked and unlocked positions. According to an embodiment, the lock block cover 46 has an inner surface and the at least one actuator stop 56 protrudes from a center portion of the hinged lock block cover 46 inner surface and is configured such that, when the lock block cover 46 is in the closed position, the at least one actuator stop 56 inhibits actuation of the projecting locking bolt 40 between the locked and unlocked positions.

In the illustrated embodiment, the projecting locking bolt 40 is positioned on a lower end of the astragal assembly 2A, and the receiving well 44 is formed in the lower sill 14. In other embodiments, projecting locking bolts 40 may be positioned on lower and upper ends of the astragal assembly 2A, and corresponding receiving wells 44 may be formed in both the lower sill 14 and upper jamb head 10. In such embodiments, the projecting locking bolts 40 may employ a shared actuator or independent actuators. In still other embodiments, projecting locking bolt 40 may be positioned on the upper end of the astragal assembly 2A but not on the lower end of the astragal assembly 2A, in which case the actuator 42 may extend or retract the locking bolt 40 from a receiving well 44 in the upper jamb head 10 alone.

Figure 3:
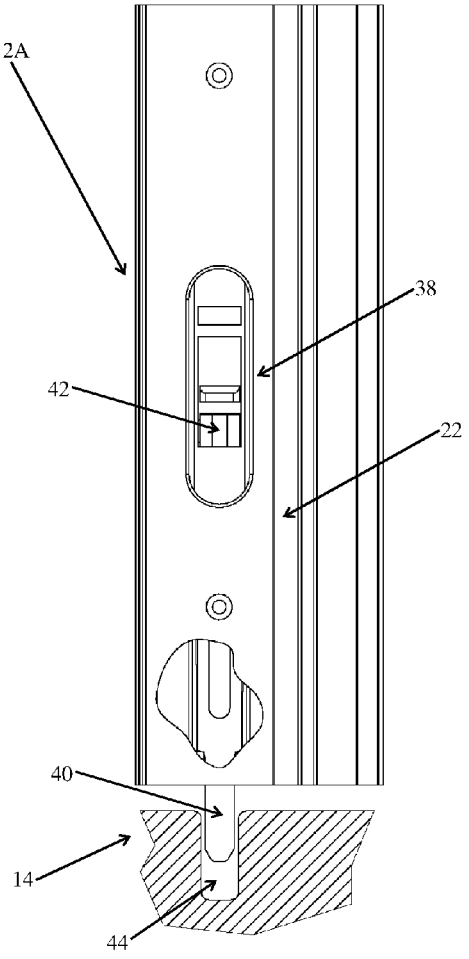
FIG. 3 is a partial side elevation view of the embodiment of the astragal assembly shown in FIG. 1, with a portion removed and illustrating the locking mechanism of the astragal assembly wherein the slidable lock block cover is open.

With reference to FIG. 3, the astragal assembly 2A may include a slidable lock block 38 mounted in the rearward or inner astragal strip 28 and suited for locking the inactive door 4A in a closed position. For example, the slidable lock block 38 may include an actuating member, such as a projecting locking bolt 40 that is operatively connected to an actuator 42. The projecting locking bolt 40 and the actuator 42 are both housed and mounted in the rearward or inner astragal strip 28. The actuator 42 may be engaged to selectively move the projecting locking bolt 40 between an extended, locked position for immobilizing the astragal strip 28 and inactive door 4A and, alternatively, a retracted, unlocked position for releasing the astragal strip 28 and inactive door 4A. In the extended position, the projecting locking bolt 40 may extend into a receiving well 44 of the lower sill 14 to hold the inactive door 4A closed. In the unlocked position, the locking bolt 40 may be retracted into the astragal assembly 2A so that the inactive door 4A may be opened. In the illustrated embodiment, not all details of the projecting locking bolt 40 are shown. However, it would be understood to one of ordinary skill in the art that several different locking bolt mechanisms could be used, such as those which are spring-loaded.

In the illustrated embodiment, the projecting locking bolt 40 is positioned on a lower end of the astragal assembly 2A, and the receiving well 44 is formed in the lower sill 14. In other embodiments, projecting locking bolts 40 may be positioned on lower and upper ends of the astragal assembly 2A, and corresponding receiving wells 44 may be formed in both the lower sill 14 and upper jamb head 10. In such embodiments, the projecting locking bolts 40 may employ a shared actuator or independent actuators. In still other embodiments, projecting locking bolt 40 may be positioned on the upper end of the astragal assembly 2A but not on the lower end of the astragal assembly 2A, in which case the actuator 42 may extend or retract the locking bolt 40 from a receiving well 44 in the upper jamb head 10 alone.

Figure 4:
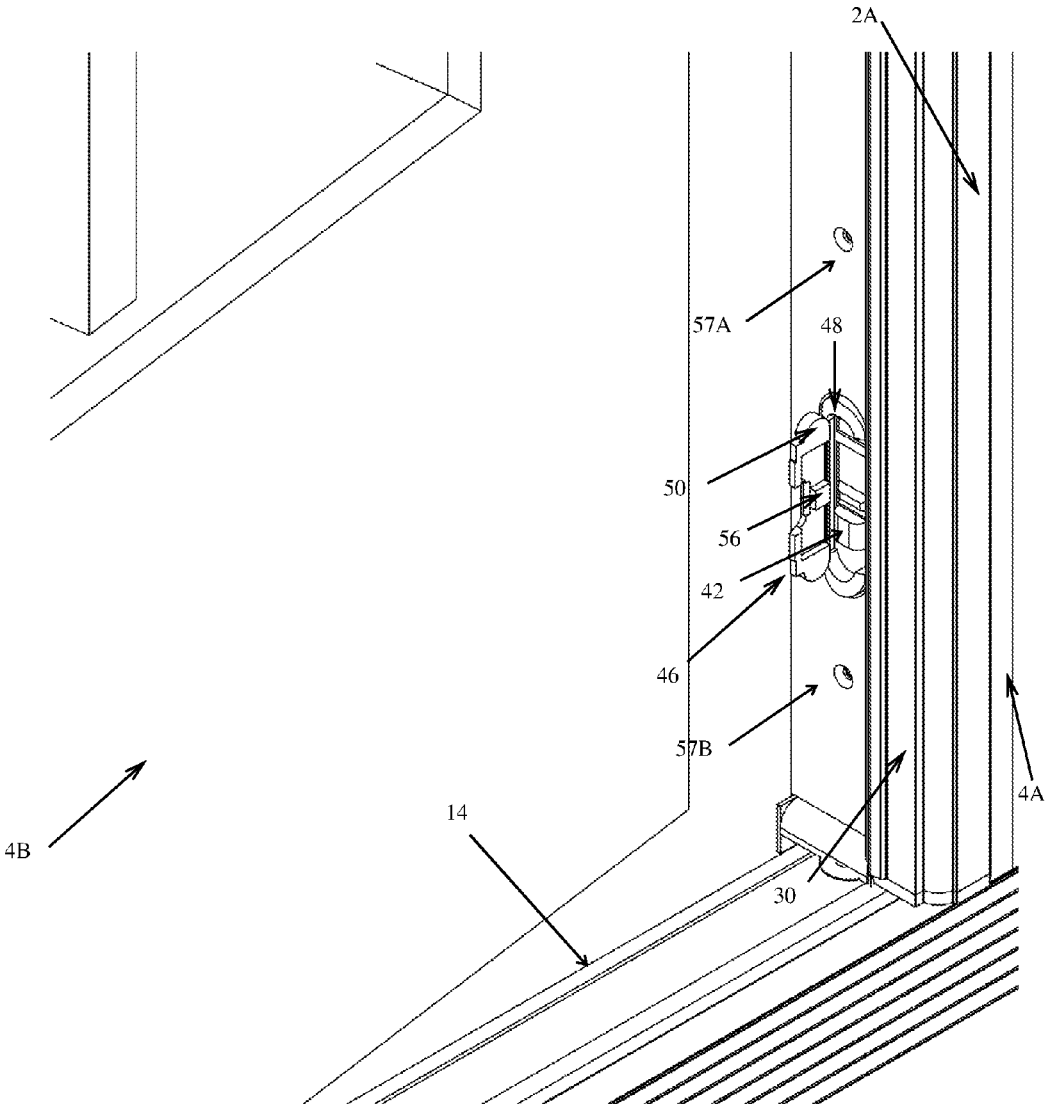
FIG. 4 is a partial perspective view of an astragal assembly with a slidable lock block cover, illustrating the astragal assembly and open slide lock block cover positioned between double doors.

With reference to FIG. 4, the cover portion 50 of the slidable lock block cover 46 is open, is a view of the double doors 4, astragal assembly 2A, and slide lock block cover 46. In this embodiment, the cover portion 50 of the slide lock block cover 46 opens toward the active door 4B and the door stop portion 30 such that if the cover portion 50 of the slide lock block cover 46 is left open, the closing of the active door 4B will also move the cover portion 50 of the slide lock block cover 46 into the closed position.

Figure 5A:
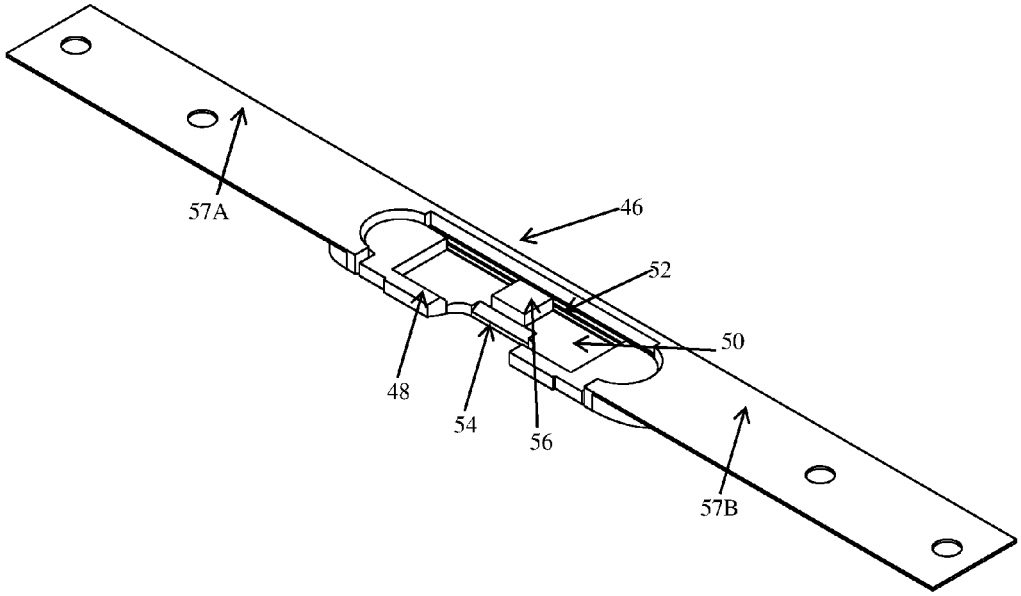
FIGS. 5A and 5B are perspective and top plan views, respectively, of an embodiment of the slidable lock block cover separated from the astragal assembly.
Figure 5B:
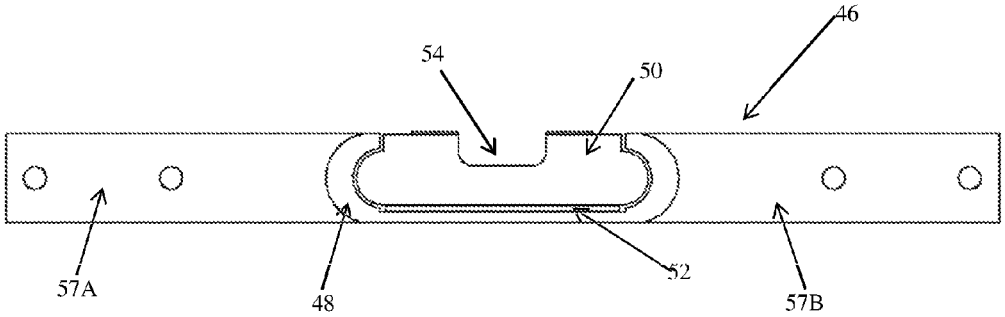

FIG. 5A is a perspective view of the slidable lock block cover 46, depicting the inner face of the slidable lock block cover 46, which when installed, faces the inactive door 4A. FIG. 5B is a perspective view of the slidable lock block cover 46, depicting the outer face of the slidable lock block cover 46, which when installed, faces the active door 4B. In this embodiment, the frame portion 48 of the slidable lock block cover 46 comprises extensions 57A and 57B at each end, which may be used to attach the slidable lock block cover 46 to the astragal assembly 2 through a variety of means, such as screws, nails, or adhesive. In this embodiment, the cover portion 50 may be manufactured from a flexible material such as polypropylene or a material comprising polypropylene and the hinge 52 comprises a living hinge. Further, in this embodiment, the cover portion 50 comprises a finger pull mechanism 54, opposite the hinge 52. The finger pull mechanism 54 comprises a recessed area of the cover portion 50 of the slidable lock block cover 46, such that a user may insert a finger into the finger pull mechanism and may use the finger pull mechanism 54 to rotate the cover portion 50 about the hinge 52 between the open and closed positions.

Therefore according to an embodiment, the slidable lock block 38 can be vertically mounted in a bottom end of the astragal strip 28, and the slidable lock block 38 can comprise the downwardly projecting locking bolt 40 configured such that, when the lock block is in the locked position, the projecting locking bolt 40 immobilizes the astragal strip 28 and inactive door 4A by extending downwardly from a bottom edge of the inactive door 4A, and, when the slidable lock block 38 is in the unlocked position, the projecting locking bolt 40 is contained within the astragal strip 28. Alternatively, in an embodiment not shown, the slidable lock block 38 is vertically mounted in a top end of the astragal strip 28, and the lock block 38 comprises an upwardly projecting locking bolt 40 configured such that, when the slidable lock block 38 is in the locked position, the projecting locking bolt 40 immobilizes the astragal strip 28 and inactive door 4A by extending upwardly from an upper edge of the inactive door 4A, and, when the slidable lock block 38 is in the unlocked position, the projecting locking bolt 40 is contained within the astragal strip 28. In accordance with yet another embodiment not shown, the astragal assembly 2 may comprise both such an upper and lower slide lock mechanism 24.

Figure 6:
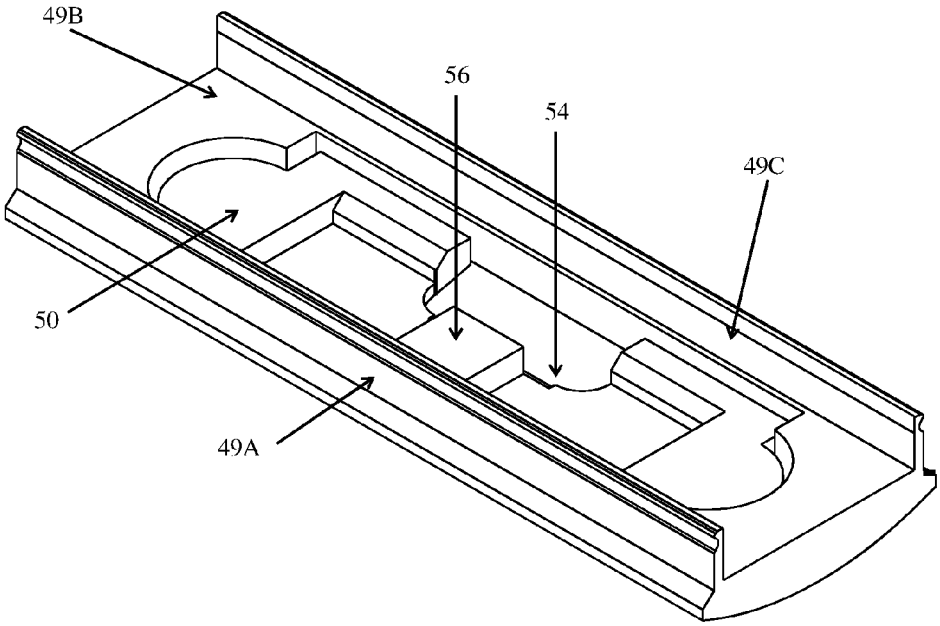
FIG. 6 is a bottom perspective view of another embodiment of the slidable lock block cover separated from the astragal assembly.

FIG. 6 is a view of the slide lock block cover 46 and the astragal assembly 2. In this embodiment, the slide lock block cover 46 has a U-shaped frame portion 48 with three substantially planar faces 49A, 49B, and 49C, with two of the substantially planar faces 49A and 49C extending orthogonally from opposing edges of the middle substantially planar face 49B such that the slide lock block cover 46 can be attached to the astragal assembly 2 by placing the perpendicular faces 49A and 49C of the frame portion 49 into corresponding channels in the astragal assembly 2.

Figure 7:
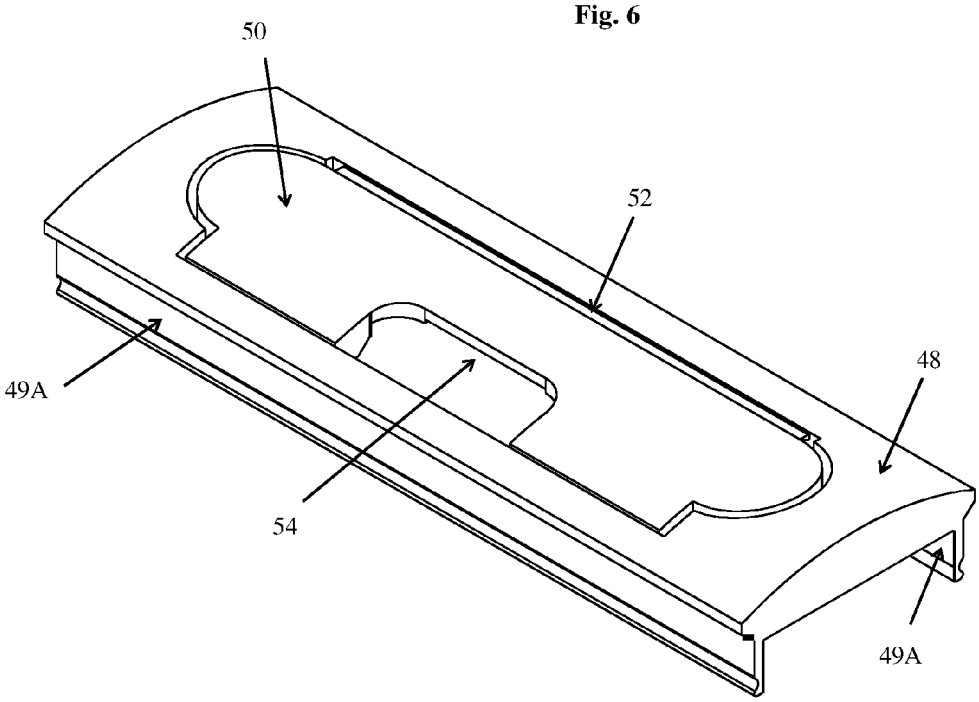
FIG. 7 is a top perspective view of the embodiment of the slidable lock block cover in FIG. 6 separated from the astragal assembly.

FIG. 7 is a view of the slide lock block cover 46 and the astragal assembly 2. In this embodiment, the slide lock block cover 46 has a U-shaped frame portion 48 with three substantially planar faces 49A, 49B, and 49C, with two of the substantially planar faces 49A and 49C extending orthogonally from opposing edges of the middle substantially planar face 49B such that the slide lock block cover 46 can be attached to the astragal assembly 2 by placing the perpendicular faces 49A and 49C of the frame portion 49 into corresponding channels in the astragal assembly 2.

Figure 8:
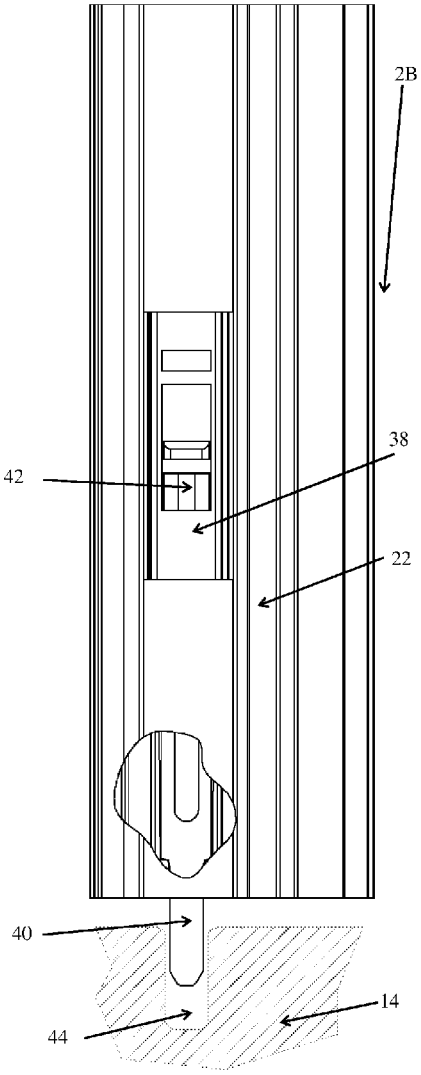
FIG. 8 is a partial side elevation view of the embodiment of the slidable lock block cover in FIG. 6 in an astragal assembly, with a portion removed and illustrating the locking mechanism of the astragal assembly wherein the slidable lock block cover is open.

With reference to FIG. 8, the astragal assembly 2B may include a slidable lock block 38 mounted in the rearward or inner astragal strip 28 and suited for locking the inactive door 4A in a closed position. For example, the slidable lock block 38, which is covered by the slidable lock block cover 46, may include an actuating member, such as a projecting locking bolt 40, that is operatively connected to an actuator 42. The projecting locking bolt 40 and the actuator 42 are both housed and mounted in the rearward or inner astragal strip 28. The actuator 42 may be engaged to selectively move the projecting locking bolt 40 between an extended, locked position for immobilizing the astragal strip 28 and inactive door 4A and, alternatively, a retracted, unlocked position for releasing the astragal strip 28 and inactive door 4A. In the extended position, the projecting locking bolt 40 may extend into a receiving well 44 of the lower sill 14 to hold the inactive door 4A closed. In the unlocked position, the locking bolt 40 may be retracted into the astragal assembly 2B so that the inactive door 4A may be opened. In the illustrated embodiment, not all details of the projecting locking bolt 40 are shown. However, it would be understood to one of ordinary skill in the art that several different locking bolt mechanisms could be used, such as those which are spring-loaded.

In this embodiment, no slidable lock block cover 46 is pictured, although it would be understood from the disclosures above that a slidable lock block cover 46 could be inserted into the longitudinal channels 58A and 58B on either side of the slidable lock block.

In the illustrated embodiment, the projecting locking bolt 40 is positioned on a lower end of the astragal assembly 2B, and the receiving well 44 is formed in the lower sill 14. In other embodiments, projecting locking bolts 40 may be positioned on lower and upper ends of the astragal assembly 2B, and corresponding receiving wells 44 may be formed in both the lower sill 14 and upper jamb head 10. In such embodiments, the projecting locking bolts 40 may employ a shared actuator or independent actuators. In still other embodiments, projecting locking bolt 40 may be positioned on the upper end of the astragal assembly 2B but not on the lower end of the astragal assembly 2B, in which case the actuator 42 may extend or retract the locking bolt 40 from a receiving well 44 in the upper jamb head 10 alone.

Figure 9:
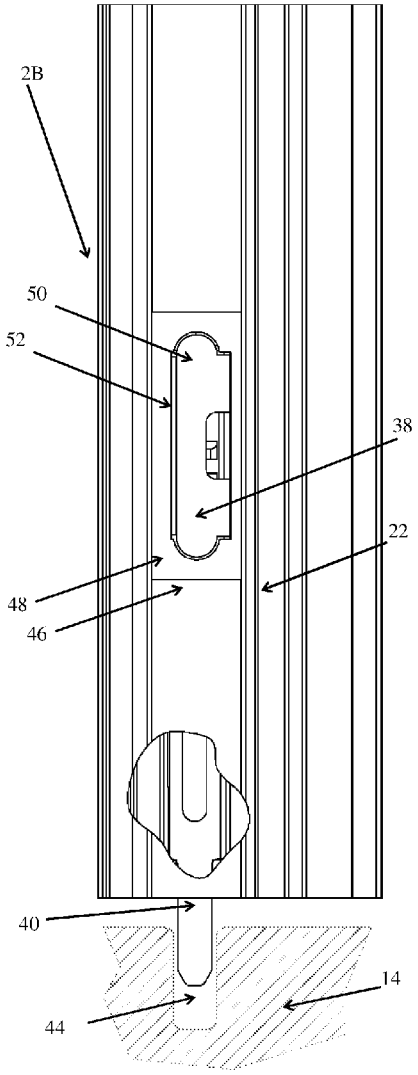
FIG. 9 is a partial side elevation view of the embodiment of the slidable lock block cover in FIG. 6 in an astragal assembly, with a portion removed and illustrating the locking mechanism of the astragal assembly wherein the slidable lock block cover is closed.

With reference to FIG. 9, the astragal assembly 2B may include a slidable lock block 38 mounted in the rearward or inner astragal strip 28 and suited for locking the inactive door 4A in a closed position. For example, the slidable lock block 38 may include an actuating member, such as a projecting locking bolt 40, that is operatively connected to an actuator 42. The projecting locking bolt 40 and the actuator 42 are both housed and mounted in the rearward or inner astragal strip 28. The actuator 42 may be engaged to selectively move the projecting locking bolt 40 between an extended, locked position for immobilizing the astragal strip 28 and inactive door 4A and, alternatively, a retracted, unlocked position for releasing the astragal strip 28 and inactive door 4A. In the extended position, the projecting locking bolt 40 may extend into a receiving well 44 of the lower sill 14 to hold the inactive door 4A closed. In the unlocked position, the locking bolt 40 may be retracted into the astragal assembly 2B so that the inactive door 4A may be opened. In the illustrated embodiment, not all details of the projecting locking bolt 40 are shown. However, it would be understood to one of ordinary skill in the art that several different locking bolt mechanisms could be used, such as those which are spring-loaded.

In the illustrated embodiment, the projecting locking bolt 40 is positioned on a lower end of the astragal assembly 2B, and the receiving well 44 is formed in the lower sill 14. In other embodiments, projecting locking bolts 40 may be positioned on lower and upper ends of the astragal assembly 2B, and corresponding receiving wells 44 may be formed in both the lower sill 14 and upper jamb head 10. In such embodiments, the projecting locking bolts 40 may employ a shared actuator or independent actuators. In still other embodiments, projecting locking bolt 40 may be positioned on the upper end of the astragal assembly 2B but not on the lower end of the astragal assembly 2B, in which case the actuator 42 may extend or retract the locking bolt 40 from a receiving well 44 in the upper jamb head 10 alone.

Figure 10:
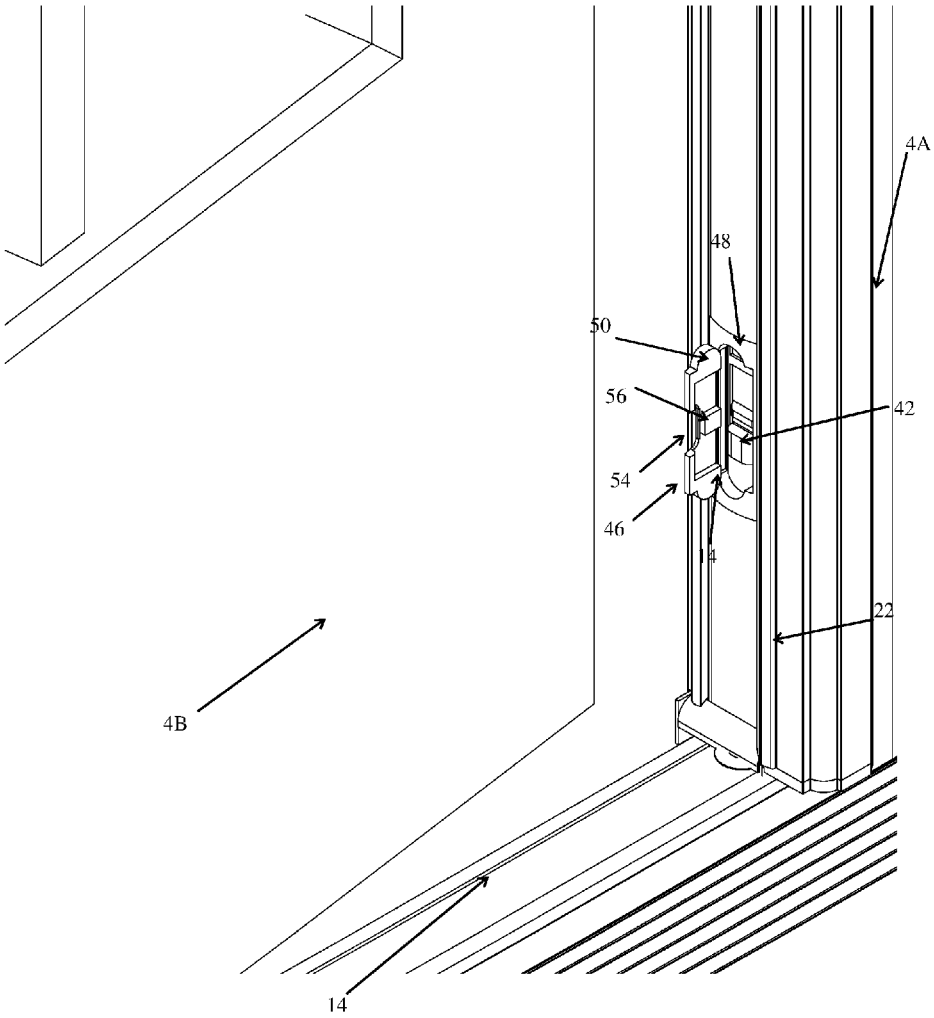
FIG. 10 is a partial perspective view of the embodiment of the slidable lock block cover in FIG. 6 in an astragal assembly with a slidable lock block cover, illustrating the astragal assembly and open slide lock block cover positioned between double doors.

With reference to FIG. 10, the cover portion 50 of the slidable lock block cover 46 is open, is a view of the double doors 4, astragal assembly 2B, and slide lock block cover 46. In this embodiment, the cover portion 50 of the slide lock block cover 46 opens toward the active door 4B and the door stop portion 30 such that if the cover portion 50 of the slide lock block cover 46 is left open, the closing of the active door 4B will also move the cover portion 50 of the slide lock block cover 46 into the closed position.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereof.

What is claimed is:

1. An astragal assembly for use with a double door installation that includes an active door and an inactive door having substantially abutting generally vertical inside edge portions when the doors are closed, said astragal assembly comprising:

an elongated astragal strip extending along the vertical inside edge portion of the inactive door when the inactive door is closed and being securable to the vertical inside edge portion of the inactive door;

a door stop on said astragal strip for engaging the active door when closed;

a slidable lock block mounted in said astragal strip, said lock block comprising a projecting bolt selectively positionable between a locked position for immobilizing the astragal strip and inactive door and, alternatively, an unlocked position for releasing the astragal strip and inactive door; and a lock block cover on said astragal strip proximate the slide lock block and comprising a cover portion which is selectively moveable between a closed position, wherein the cover portion is substantially flush with the astragal strip and the cover portion blocks access to the slide lock block and inhibits actuation of the projecting bolt between the locked and unlocked positions, and, alternatively, an open position, wherein the slidable lock block is accessible for movement of the projecting bolt between the locked and unlocked positions;

the lock block cover further comprises a hinge arranged such that the cover portion can be rotated on the hinge between the open and closed positions;

the lock block cover further comprises a frame portion mounted to the astragal strip, at least partially surrounding the cover portion, and connected to the cover portion with the hinge; and the cover portion of the hinged lock block cover is configured to open toward the active door and the door stop, such that closing the active door can move the cover portion from the opened to closed position.

2. The astragal assembly of claim 1, wherein the elongated astragal strip extends substantially along the entire length of the inactive door and a bottom end of the astragal strip is positionable adjacent to the bottom edge portion of the inactive door.

3. The astragal assembly of claim 1, wherein the door stop extends substantially along the entire length of the astragal strip.

4. The astragal assembly of claim 1, wherein the vertical edge portions of the active door and inactive door overlie a sill when the doors are closed.

5. The astragal assembly of claim 1, wherein the slide lock block is vertically mounted in a bottom end of the astragal strip, and the lock block comprises a downwardly projecting bolt configured such that, when the lock block is in the locked position, the projecting bolt immobilizes the astragal strip and inactive door by extending downwardly from a bottom edge of the inactive door, and, when the lock block is in the unlocked position, the projecting bolt is contained within the astragal assembly.

6. The astragal assembly of claim 1, wherein the slide lock block is vertically mounted in a top end of the astragal strip, and the lock block comprises an upwardly projecting bolt configured such that, when the lock block is in the locked position, the projecting bolt immobilizes the astragal strip and inactive door by extending upwardly from an upper edge of the inactive door, and, when the lock block is in the unlocked position, the projecting bolt is contained within the astragal assembly.

7. The astragal assembly of claim 1, wherein the slideable lock block is a first lock block and the lock block cover is a first lock block cover, the first lock block is mounted proximate one end of the astragal strip, and the assembly further comprises:

a second slidable lock block mounted in said astragal strip proximate another end of the astragal strip, said second lock block comprising a projecting bolt selectively positionable between a locked position for immobilizing the astragal strip and inactive door and, alternatively, an unlocked position for releasing the astragal strip and inactive door; and a second lock block cover on said astragal strip proximate the second slide lock block and comprising a cover portion which is selectively moveable between a closed position, wherein the cover portion is substantially flush with the astragal strip and the cover portion blocks access to the second slide lock block and inhibits actuation of the projecting bolt of the second slide lock block between the locked and unlocked positions, and, alternatively, an open position, wherein the second slidable lock block is accessible for movement of the projecting bolt of the second slide lock block between the locked and unlocked positions.

8. The astragal assembly of claim 1, wherein the cover portion of the lock block cover is substantially planar, and comprises an outer surface which faces the vertical inside edge portion of the closed active door, and an inner surface which faces the slidable lock block.

9. The astragal assembly of claim 1, wherein the cover portion of the hinged lock block cover further comprises a latch or finger pull mechanism on a side opposite from the hinge.

10. The astragal assembly of claim 1, wherein the hinge is a living hinge.

11. The astragal assembly of claim 1, wherein an inner surface of a center portion of the hinged lock block cover comprises at least one protrusion configured such that, when the lock block cover is in the closed position, the at least one protrusion inhibits actuation of the projecting bolt between the locked and unlocked positions.

12. The astragal assembly of claim 11, wherein the frame portion of the lock block cover comprises at least three substantially planar surfaces, including one center surface which substantially surrounds the center portion, and two outer surfaces which are substantially orthogonal to the center surface, such that the two outer surfaces of the frame portion of the lock block cover may be attached to preformed channels on the astragal strip.

13. The astragal assembly of claim 1, wherein the lock block cover is formed of a substantially rigid material, comprising aluminum, fiberglass, or plastic.

14. The astragal assembly of claim 1, wherein the lock block cover is formed of a material comprising polypropylene.

15. The astragal assembly of claim 1, wherein the frame portion of the lock block cover is elongated such that the frame portion extends beyond the lock block cover, is substantially longer than the lock block cover, and is attachable to the astragal assembly using mechanical fasteners.

16. A hinged lock block cover configured to be attached to an elongated astragal strip in an astragal assembly comprising:

a cover portion which is selectively moveable between a closed position, wherein the cover portion is substantially flush with the astragal strip and the cover portion blocks access to a slide lock block and inhibits actuation of a projecting bolt between locked and unlocked positions and, alternatively, an open position, wherein the slidable lock block is accessible for movement of the projecting bolt between the locked and unlocked positions, and the cover portion of the hinged lock block cover is configured to open toward an active door of a double door installation that includes the active door and an inactive door, such that closing the active door can move the cover portion from the opened to closed position;

a hinge arranged such that the cover portion can be rotated on the hinge between the open and closed positions; and a frame portion configured to be mounted to the astragal strip, at least partially surrounding the cover portion, and connected to the cover portion with the hinge.

17. A hinged lock block cover comprising:

a cover portion which is selectively moveable between a closed position and an open position, wherein the lock block cover is configured to be used in an astragal assembly with a double door installation that includes an active door and an inactive door having substantially abutting generally vertical inside edge portions when the doors are closed, said astragal assembly comprising:

an elongated astragal strip extending along the vertical inside edge portion of the inactive door when the inactive door is closed and being securable to the vertical inside edge portion of the inactive door;

a door stop on said astragal strip for engaging the active door when closed; and a slideable lock block mounted in said astragal strip, said lock block comprising a projecting bolt selectively positionable between a locked position for immobilizing the astragal strip and inactive door and, alternatively, an unlocked position for releasing the astragal strip and inactive door;

wherein the cover portion of the hinged lock block cover is configured to open toward the active door, such that closing the active door can move the cover portion from the opened to closed position;

a hinge arranged such that the cover portion can be rotated on the hinge between the open and closed positions; and a frame portion configured to be mounted to the astragal strip, at least partially surrounding the cover portion, and connected to the cover portion with the hinge.

18. The method of claim 17, wherein the lock block cover is further configured to be detachable from the astragal assembly.

* * * * *